US011148908B2

(12) United States Patent
Rampone et al.

(10) Patent No.: US 11,148,908 B2
(45) Date of Patent: Oct. 19, 2021

(54) ELEVATOR DOOR WITH SENSOR FOR DETERMINING WHETHER TO REOPEN DOOR

(71) Applicant: Otis Elevator Company, Farmington, CT (US)

(72) Inventors: Joseph C. Rampone, Colchester, CT (US); Walter Thomas Schmidt, Marlborough, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 518 days.

(21) Appl. No.: 16/170,983

(22) Filed: Oct. 25, 2018

(65) Prior Publication Data

US 2020/0131006 A1 Apr. 30, 2020

(51) Int. Cl.
*B66B 13/26* (2006.01)
*B66B 13/14* (2006.01)
*B66B 13/30* (2006.01)

(52) U.S. Cl.
CPC ..... *B66B 13/26* (2013.01); *B66B 13/143* (2013.01); *B66B 13/303* (2013.01)

(58) Field of Classification Search
CPC ..... B66B 13/26; B66B 13/143; B66B 13/303
See application file for complete search history.

(56) References Cited

U.S. PATENT DOCUMENTS 4,506,765 A 3/1985 Payne et al.
4,693,340 A * 9/1987 Shanks ..... B66B 13/26 187/317
5,641,951 A * 6/1997 Cai ..... B66B 13/26 187/317
7,093,692 B2 8/2006 Koura
8,284,071 B2 10/2012 Peng et al.
9,212,028 B2 12/2015 Novak
9,751,727 B1 9/2017 Novak
(Continued)

FOREIGN PATENT DOCUMENTS

CN 101353129 B 2/2011
CN 102674123 A 9/2012
CN 106044502 A 10/2016
(Continued)

OTHER PUBLICATIONS

European Search Report; Application No. 19205497.1-1017; dated Jul. 24, 2020; 9 pages.

*Primary Examiner* — Jeffrey Donels
(74) *Attorney, Agent, or Firm* — Cantor Colburn LLP

(57) ABSTRACT

Disclosed is a system for an elevator door of an elevator car, wherein a controller controls the elevator door to travel in a proximate direction when closing and travel in a distal direction when opening, the system including: a panel that forms an exterior surface of an elevator door, the panel including a front surface extending in a widthwise direction between a proximate end and an opposing distal end to form a front surface of the elevator door, the panel including a proximate end surface extending in a depthwise direction to form a proximate end surface of the elevator door, the proximate end surface of the panel comprising a resilient portion that is capable of engaging a sensor in the panel when the elevator door is closing, and thereafter the controller instructs the elevator door to reopen.

16 Claims, 3 Drawing Sheets

(56) References Cited

U.S. PATENT DOCUMENTS

2019/0345751 A1* 11/2019 Sun ..... B66B 13/26

FOREIGN PATENT DOCUMENTS

| | | | |
|---|---|---|---|
| CN | 104703906 | B | 11/2016 |
| CN | 106470932 | A | 3/2017 |
| CN | 107352371 | A | 11/2017 |
| EP | 2584375 | B1 | 4/2013 |
| EP | 3255010 | A1 | 12/2017 |
| JP | H0826636 | A | 1/1996 |
| JP | 2005008300 | A | 1/2005 |
| JP | 2006168843 | A | 6/2006 |
| JP | 2007290827 | A | 11/2007 |
| JP | 4202007 | B2 | 12/2008 |
| JP | 2010058863 | A2 | 3/2010 |
| JP | 2010126323 | A | 6/2010 |
| JP | 2011102164 | A | 5/2011 |
| JP | 2011178553 | A | 9/2011 |
| JP | 6303751 | B2 | 4/2018 |
| KR | 101324093 | A | 12/2012 |
| KR | 101769732 | B1 | 8/2017 |

* cited by examiner

ELEVATOR DOOR WITH SENSOR FOR DETERMINING WHETHER TO REOPEN DOOR

BACKGROUND

The embodiments herein relate to an elevator and more specifically to an elevator with a motion sensor for determining whether to re-open the elevator doors.

Elevator doors typically consist of two panels that close upon each other. There is the possibility for a passenger to put their hand or arm between the panels to prevent the elevator doors from closing. This could cause physical harm to the passenger if the elevator doors do not stop.

SUMMARY

Disclosed is a system for an elevator door of an elevator car, wherein a controller controls the elevator door to travel in a proximate direction when closing and travel in a distal direction when opening, the system comprising: a panel that forms an exterior surface of an elevator door, the panel including a front surface extending in a widthwise direction between a proximate end and an opposing distal end to form a front surface of the elevator door, the panel including a proximate end surface extending in a depthwise direction to form a proximate end surface of the elevator door, the proximate end surface of the panel comprising a resilient portion, and wherein when the elevator door is closing, the controller renders a plurality of determinations including: a first determination to monitor for a communication from a sensor in the door panel, wherein the communication is indicative of the resilient portion deflecting in the distal direction, a second determination to reopen the elevator door upon detecting deflection in the distal direction, and wherein the controller transmits instructions to the elevator to effect the second determination.

In addition to one or more of the above disclosed features and elements or as an alternate the sensor is in a cavity in the door panel, the cavity being defined by: (i) the front surface of the panel, (ii) the proximate end surface of the panel, (iii) a first return surface of the panel that is depthwise offset from the front surface of the panel and connected to the proximate end surface of the panel, and (iv) a first internal surface of the panel that is distally offset from the proximate end surface of the panel and connected to both the front surface of the panel and the first return surface of the panel, wherein the resilient portion extends distally into the cavity through the proximate end surface of the panel to operationally communicate with the controller.

In addition to one or more of the above disclosed features and elements or as an alternate the resilient portion forms a strip extending in a heightwise direction for the door panel.

In addition to one or more of the above disclosed features and elements or as an alternate the resilient portion is an elastomer.

In addition to one or more of the above disclosed features and elements or as an alternate the sensor is a pressure sensor.

In addition to one or more of the above disclosed features and elements or as an alternate the proximate end of the panel includes a proximate J-channel formed by (i) the front surface of the panel, (ii) the first internal surface of the cavity, and (iii) a distal portion of the first return surface that extends distally from the cavity.

In addition to one or more of the above disclosed features and elements or as an alternate the distal end of the panel includes a distal end J-channel formed by (i) the front surface of the panel, (ii) a distal end surface of the panel that is connected to the front surface of the panel and extends parallel to the proximate end surface of the panel, and (iii) a second return surface of the panel that is connected to the distal end surface of the panel and offset from the front surface of the panel in a same depthwise direction as the first return surface.

In addition to one or more of the above disclosed features and elements or as an alternate the distal end surface of the panel forms a distal end surface of the elevator door, and wherein the first return surface and second return surface are coplanar, whereby the proximate J-channel and distal J-channel are configured to fixedly connect the panel to the elevator door.

In addition to one or more of the above disclosed features and elements or as an alternate a unitary sheet of metal forms the panel.

In addition to one or more of the above disclosed features and elements or as an alternate the system includes an elevator door and the panel fixedly connected to the elevator door.

The foregoing features and elements may be combined in various combinations without exclusivity, unless expressly indicated otherwise. These features and elements as well as the operation thereof will become more apparent in light of the following description and the accompanying drawings. It should be understood, however, that the following description and drawings are intended to be illustrative and explanatory in nature and non-limiting.

BRIEF DESCRIPTION OF THE DRAWINGS

The present disclosure is illustrated by way of example and not limited in the accompanying figures in which like reference numerals indicate similar elements.

DETAILED DESCRIPTION

Figure 1:
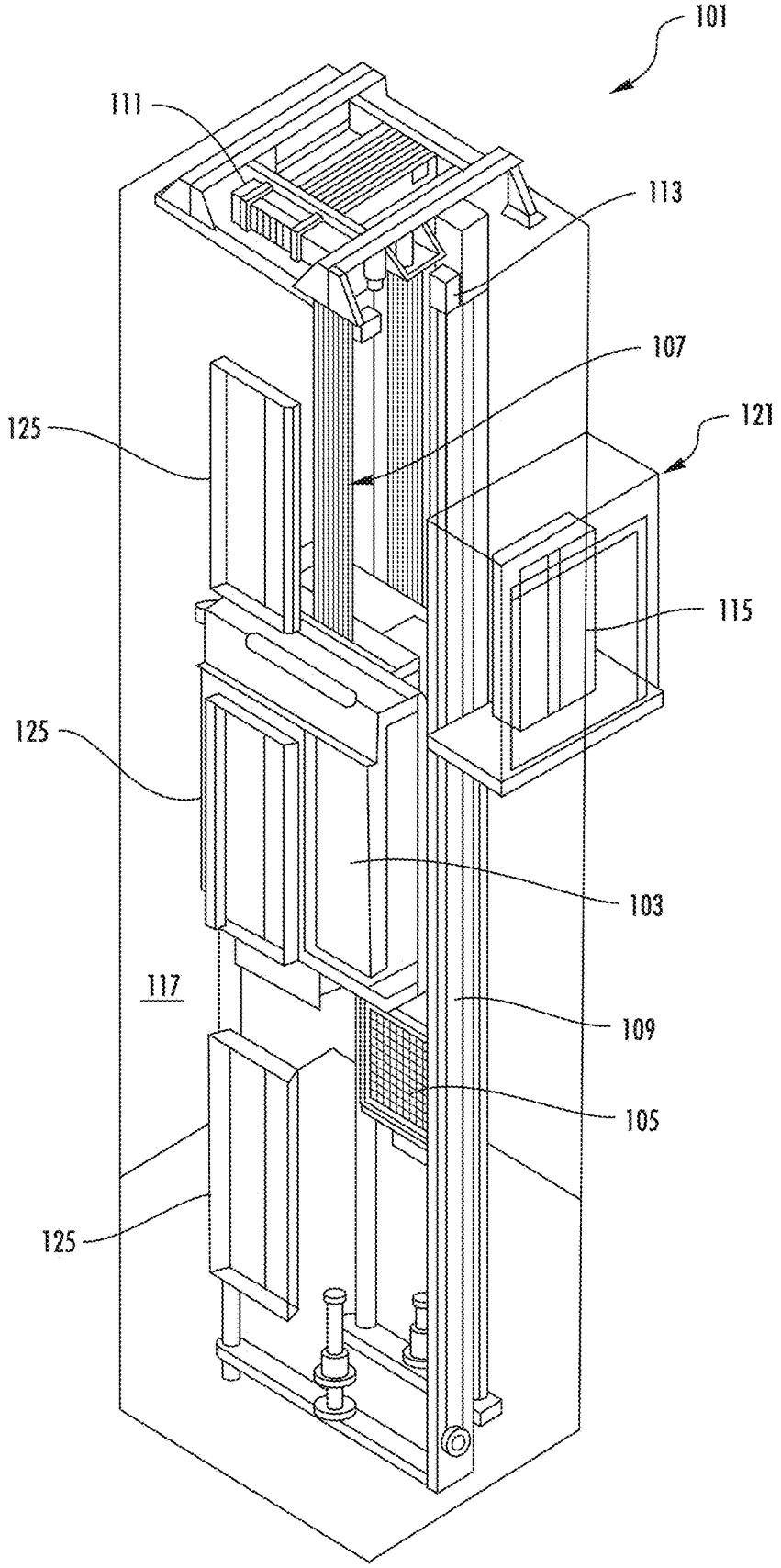
FIG. 1 is a schematic illustration of an elevator system that may employ various embodiments of the present disclosure.

FIG. 1 is a perspective view of an elevator system 101 including an elevator car 103, a counterweight 105, a tension member 107, a guide rail 109, a machine 111, a position reference system 113, and a controller 115. The elevator car 103 and counterweight 105 are connected to each other by the tension member 107. The tension member 107 may include or be configured as, for example, ropes, steel cables, and/or coated-steel belts. The counterweight 105 is configured to balance a load of the elevator car 103 and is configured to facilitate movement of the elevator car 103 concurrently and in an opposite direction with respect to the counterweight 105 within an elevator hoistway 117 and along the guide rail 109.

The tension member 107 engages the machine 111, which is part of an overhead structure of the elevator system 101. The machine 111 is configured to control movement between the elevator car 103 and the counterweight 105. The position reference system 113 may be mounted on a fixed part at the top of the elevator hoistway 117, such as on a support or guide rail, and may be configured to provide position signals related to a position of the elevator car 103 within the elevator hoistway 117. In other embodiments, the position reference system 113 may be directly mounted to a moving component of the machine 111, or may be located in other positions and/or configurations as known in the art. The position reference system 113 can be any device or mechanism for monitoring a position of an elevator car and/or counter weight, as known in the art. For example, without limitation, the position reference system 113 can be an encoder, sensor, or other system and can include velocity sensing, absolute position sensing, etc., as will be appreciated by those of skill in the art.

The controller 115 is located, as shown, in a controller room 121 of the elevator hoistway 117 and is configured to control the operation of the elevator system 101, and particularly the elevator car 103. For example, the controller 115 may provide drive signals to the machine 111 to control the acceleration, deceleration, leveling, stopping, etc. of the elevator car 103. The controller 115 may also be configured to receive position signals from the position reference system 113 or any other desired position reference device. When moving up or down within the elevator hoistway 117 along guide rail 109, the elevator car 103 may stop at one or more landings 125 as controlled by the controller 115. Although shown in a controller room 121, those of skill in the art will appreciate that the controller 115 can be located and/or configured in other locations or positions within the elevator system 101. In one embodiment, the controller may be located remotely or in the cloud.

The machine 111 may include a motor or similar driving mechanism. In accordance with embodiments of the disclosure, the machine 111 is configured to include an electrically driven motor. The power supply for the motor may be any power source, including a power grid, which, in combination with other components, is supplied to the motor. The machine 111 may include a traction sheave that imparts force to tension member 107 to move the elevator car 103 within elevator hoistway 117.

Although shown and described with a roping system including tension member 107, elevator systems that employ other methods and mechanisms of moving an elevator car within an elevator hoistway may employ embodiments of the present disclosure. For example, embodiments may be employed in ropeless elevator systems using a linear motor to impart motion to an elevator car. Embodiments may also be employed in ropeless elevator systems using a hydraulic lift to impart motion to an elevator car. FIG. 1 is merely a non-limiting example presented for illustrative and explanatory purposes.

Figure 3:
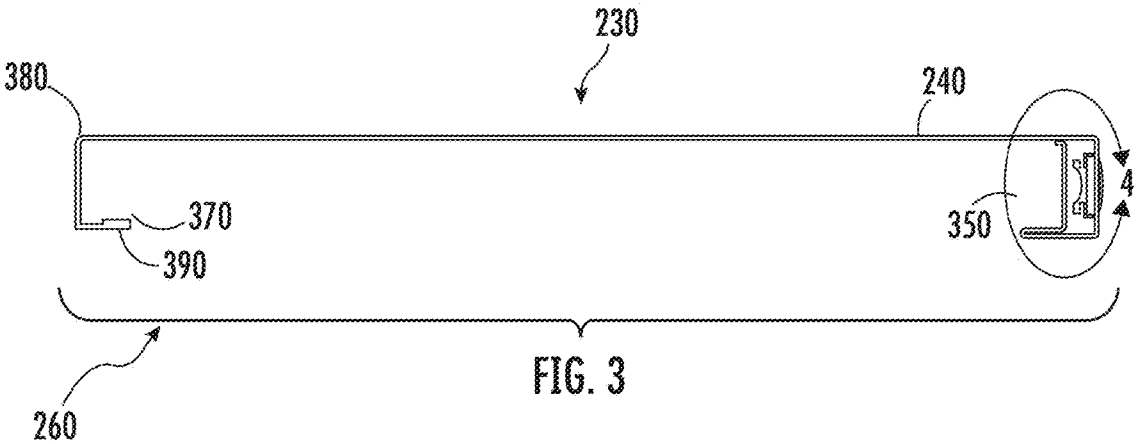
FIG. 3 illustrates features of a panel for a door of an elevator system according to an embodiment.
Figure 4:
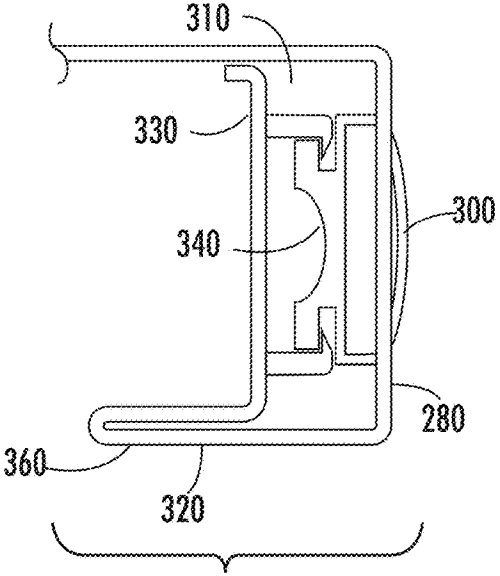
FIG. 4 illustrates additional features of the panel according to an embodiment.
Figure 2:
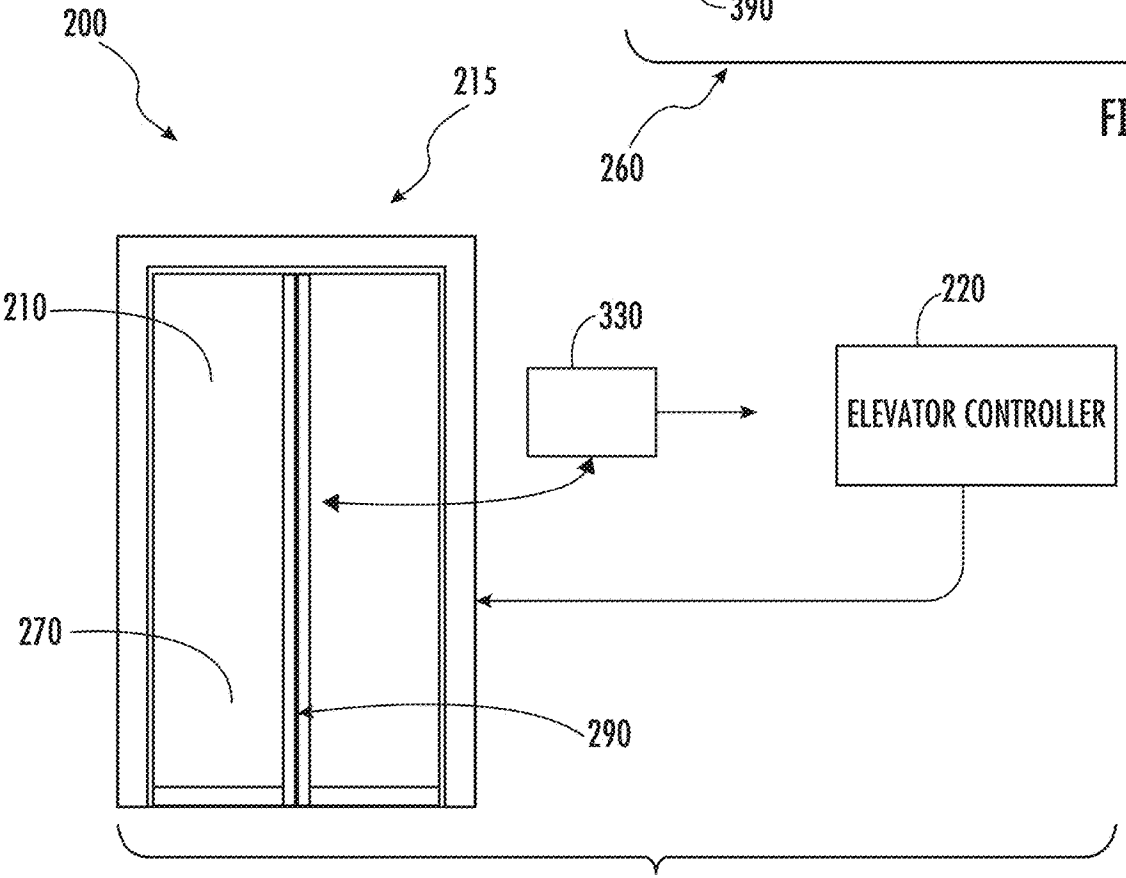
FIG. 2 illustrates features of an elevator system according to an embodiment.

Turning to FIGS. 2-4, disclosed is a system 200 for an elevator door 210 of an elevator car 215, wherein a controller 220 controls the elevator door 210 to travel in a proximate direction when closing and travel in a distal direction when opening. The system comprises a panel 230 that forms an exterior surface of the elevator door 210. The panel 230 has a front surface 240 extending in a widthwise direction between a proximate end 250 and an opposing distal end 260 to form a front surface 270 of the elevator door 210. The panel 230 has a proximate end surface 280 extending in a depthwise direction to form a proximate end surface 290 of the elevator door 210. According to a disclosed embodiment the proximate end surface 280 of the panel 230 comprises a resilient portion 300.

The resilient portion 300 may be capable of elastic deformation rather than plastic (permanent) deformation upon being depressed or otherwise engaged by a person or thing (for example an item accompanying a person) while the elevator door is closing. Such deflection may be elastic as the resilient portion 300 may be capable of returning to its original state after such engagement. For example, the resilient portion 300 may be an elastomer, plastic, rubber or other such material that is flexible and durable, whether synthetic or natural, and may be a composite and/or compound of such materials.

Figure 5:
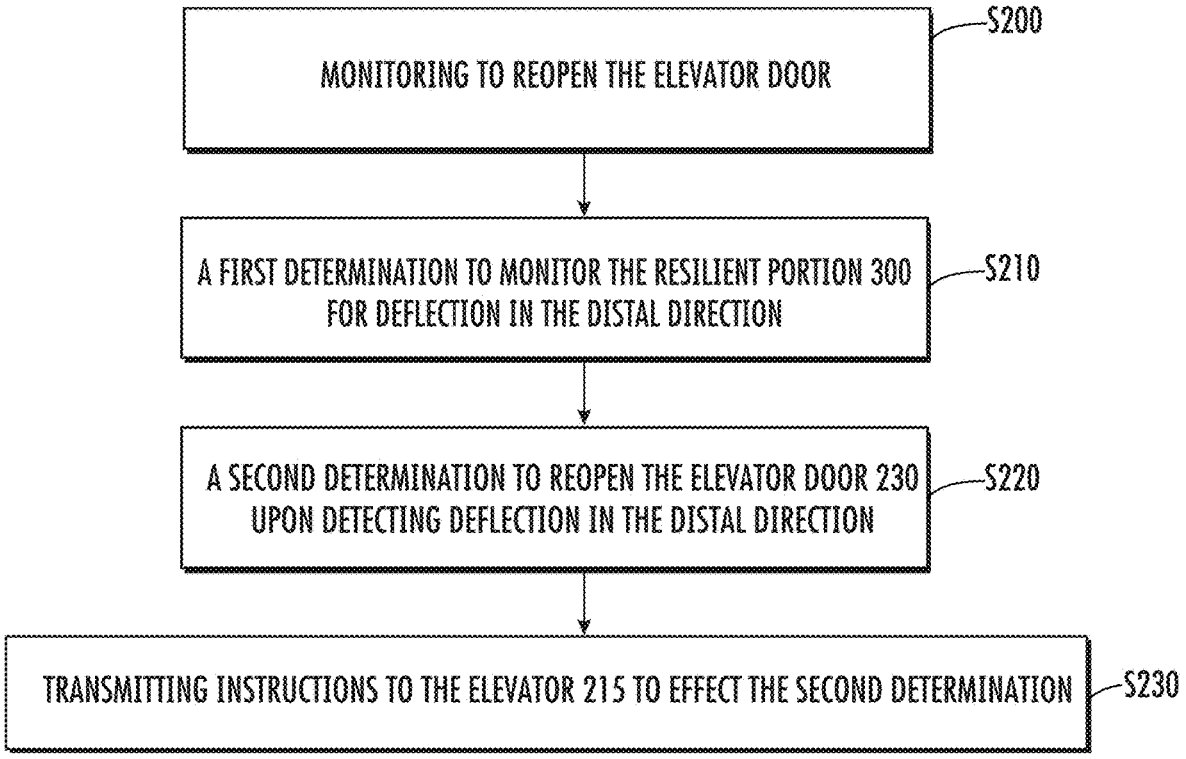
FIG. 5 illustrates a process performed by the system according to an embodiment.

Turning to FIG. 5, when the elevator door is closing, the controller 220 executes a process S200 of monitoring to reopen the elevator door. Step S200 includes step S210 of the controller 220 rendering a first determination to monitor the resilient portion 300 for deflection in the distal direction. At step S220 the controller renders a second determination to reopen the elevator door 230 upon detecting deflection in the distal direction. At step S240 the controller 220 performs step S230 of transmitting instructions to the elevator car 215 to effect the second determination.

Turning back to FIGS. 2-4, the panel 230 includes a cavity 310 defined by: (i) the front surface 240 of the panel 230, (ii) the proximate end surface 280 of the panel 230, (iii) a first return surface 320 of the panel 230 that is depthwise offset from the front surface 240 of the panel 230 and connected to the proximate end surface 280 of the panel 230, and (iv) a first internal surface 330 of the panel 230 that is distally offset from the proximate end surface 280 of the panel 230 and connected to both the front surface 240 of the panel 230 and the first return surface 320 of the panel. The resilient portion 300 may extend distally into the cavity 310 through the proximate end surface 280 of the panel 230 to operationally communicate with the controller 220.

According to an embodiment a sensor 340 is disposed in the cavity 310. The sensor 340 may sense deflection of the resilient portion 300 in the distal direction and communicating an occurrence of the deflection to the controller 220. According to an embodiment the sensor 340 is a pressure sensor. According to an embodiment, the sensor may be disposed entirely in the cavity.

According to an embodiment the proximate end 250 of the panel 230 may include a proximate J-channel 350 formed by (i) the front surface 240 of the panel 230, (ii) the first internal surface 330 of the cavity 310, and (iii) a distal portion 360 of the first return surface 320 that extends distally from the cavity 310. The distal end 260 of the panel 230 may include a distal end J-channel 370 formed by (i) the front surface 240 of the panel 230, (ii) a distal end surface 380 of the panel 230 that is connected to the front surface 240 of the panel 230 and extends parallel to the proximate end surface 280 of the panel 230, and (iii) a second return surface 390 that is connected to the distal end surface 380 of the panel 230 and offset from the front surface 240 of the panel 230 in a same depthwise direction as the first return surface 320.

According to an embodiment the distal end surface 380 of the panel 230 may form a distal end surface of the elevator door 210. In addition the first return surface 320 and second return surface 390 may be coplanar. From this configuration the proximate J-channel 350 and distal J-channel 370 may fixedly connect the panel 230 to the elevator door 210. According to an embodiment a unitary sheet of metal forms the panel. As illustrated in FIG. 2 the panel 230 may be is fixedly connected to an elevator door 210. It is to be appreciated, however, that the scope of this disclosure is not limited to embodiments in which the panel 230 is affixed to the elevator door 210.

With the above disclosure the elevator doors may operate safely and avoid injury to or harm a passenger if a hand or arm is placed between the elevator doors in order to prevent the elevator doors from closing. The above disclosed safety mechanism includes an edge protection sensor placed inside the elevator door panel and located at the edge of the elevator door 230. This edge protection sensor may be able to detect a hand or arm as it comes in contact with the elevator door edge and immediately effect in stopping the elevator door 230 from closing. Installing an edge protection sensor inside the elevator door panel may enable the elevator door 230 to be more damage resistant.

In addition, benefits the disclosed embodiments include 1) protecting the pressure sensor from impacts near the base, which would put stress on the connecting bolts to the door and possibly make the bolts fail and 2) reduce the amount the sensor juts out between the doors, so that way the doors may close more flush and the sensor may have a size that is less than a lengthwise span of the door.

As described above, embodiments may use a controller which can comprise processor-implemented processes and devices for practicing those processes, such as a processor. Embodiments can also be in the form of computer program code containing instructions embodied in tangible media, such as network cloud storage, SD cards, flash drives, floppy diskettes, CD ROMs, hard drives, or any other computer-readable storage medium, wherein, when the computer program code is loaded into and executed by a computer, the computer becomes a device for practicing the embodiments. Embodiments can also be in the form of computer program code, for example, whether stored in a storage medium, loaded into and/or executed by a computer, or transmitted over some transmission medium, such as over electrical wiring or cabling, through fiber optics, or via electromagnetic radiation, wherein, when the computer program code is loaded into an executed by a computer, the computer becomes an device for practicing the embodiments. When implemented on a general-purpose microprocessor, the computer program code segments configure the microprocessor to create specific logic circuits.

The terminology used herein is for the purpose of describing particular embodiments only and is not intended to be limiting of the present disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, element components, and/or groups thereof.

Those of skill in the art will appreciate that various example embodiments are shown and described herein, each having certain features in the particular embodiments, but the present disclosure is not thus limited. Rather, the present disclosure can be modified to incorporate any number of variations, alterations, substitutions, combinations, sub-combinations, or equivalent arrangements not heretofore described, but which are commensurate with the scope of the present disclosure. Additionally, while various embodiments of the present disclosure have been described, it is to be understood that aspects of the present disclosure may include only some of the described embodiments. Accordingly, the present disclosure is not to be seen as limited by the foregoing description, but is only limited by the scope of the appended claims.

What is claimed is:

1. A system for an elevator door of an elevator car, wherein a controller controls the elevator door to travel in a proximate direction when closing and travel in a distal direction when opening, the system comprising:

a panel that forms an exterior surface of an elevator door, the panel including a front surface extending in a widthwise direction between a proximate end and an opposing distal end to form a front surface of the elevator door, the panel including a proximate end surface extending in a depthwise direction to form a proximate end surface of the elevator door, the proximate end surface of the panel comprising a resilient portion, and wherein when the elevator door is closing, the controller renders a plurality of determinations including: a first determination to monitor for a communication from a sensor in the door panel, wherein the communication is indicative of the resilient portion deflecting in the distal direction; a second determination to reopen the elevator door upon detecting deflection in the distal direction; and wherein the controller transmits instructions to the elevator to effect the second determination;

wherein the sensor is in a cavity in the door panel, the cavity being defined by: (i) the front surface of the panel; (ii) the proximate end surface of the panel; (iii) a first return surface of the panel that is depthwise offset from the front surface of the panel and connected to the proximate end surface of the panel; and (iv) a first internal surface of the panel that is distally offset from the proximate end surface of the panel and connected to both the front surface of the panel and the first return surface of the panel; wherein the resilient portion extends distally into the cavity through the proximate end surface of the panel to operationally communicate with the controller; and wherein the proximate end of the panel includes a proximate J-channel formed by (i) the front surface of the panel, (ii) the first internal surface of the cavity, and (iii) a distal portion of the first return surface that extends distally from the cavity.

2. The system of claim 1 wherein the resilient portion forms a strip extending in a heightwise direction for the door panel.

3. The system of claim 1 wherein the resilient portion is an elastomer.

4. The system of claim 1 wherein the sensor is a pressure sensor.

5. The system of claim 1 wherein the distal end of the panel includes a distal end J-channel formed by (i) the front surface of the panel, (ii) a distal end surface of the panel that is connected to the front surface of the panel and extends parallel to the proximate end surface of the panel, and (iii) a second return surface of the panel that is connected to the distal end surface of the panel and offset from the front surface of the panel in a same depthwise direction as the first return surface.

6. The system of claim 5 wherein the distal end surface of the panel forms a distal end surface of the elevator door, and wherein the first return surface and second return surface are coplanar, whereby the proximate J-channel and distal J-channel are configured to fixedly connect the panel to the elevator door.

7. The system of claim 1 wherein a unitary sheet of metal forms the panel.

8. The system of claim 1 including an elevator door and the panel fixedly connected to the elevator door.

9. A method for an elevator controller in an elevator system to control an elevator door while the elevator door is closing, wherein the controller controls the elevator door to travel in a proximate direction when closing and travel in a distal direction when opening, and the system includes a panel that forms an exterior surface of an elevator door, the panel including a front surface extending in a widthwise direction between a proximate end and an opposing distal end to form a front surface of the elevator door, the panel including a proximate end surface extending in a depthwise direction to form a proximate end surface of the elevator door, and the proximate end surface of the panel includes a resilient portion, and the method including: rendering a first determination to monitor for a communication from a sensor in the door panel, wherein the communication is indicative of the resilient portion deflecting in the distal direction; rendering a second determination to reopen the elevator door upon detecting deflection in the distal direction; and transmitting instructions to the elevator to effect the second determination;

wherein the sensor is in a cavity in the door panel, the cavity being defined by: (i) the front surface of the panel; (ii) the proximate end surface of the panel; (iii) a first return surface of the panel that is depthwise offset from the front surface of the panel and connected to the proximate end surface of the panel; and (iv) a first internal surface of the panel that is distally offset from the proximate end surface of the panel and connected to both the front surface of the panel and the first return surface of the panel; wherein the resilient portion extends distally into the cavity through the proximate end surface of the panel to operationally communicate with the controller; and wherein the proximate end of the panel includes a proximate J-channel formed by (i) the front surface of the panel, (ii) the first internal surface of the cavity, and (iii) a distal portion of the first return surface that extends distally from the cavity.

10. The method of claim 9 wherein the resilient portion forms a strip extending in a heightwise direction for the door panel.

11. The method of claim 9 wherein the resilient portion is an elastomer.

12. The method of claim 9 wherein the sensor is a pressure sensor.

13. The method of claim 9 wherein the distal end of the panel includes a distal end J-channel formed by (i) the front surface of the panel, (ii) a distal end surface of the panel that is connected to the front surface of the panel and extends parallel to the proximate end surface of the panel, and (iii) a second return surface of the panel that is connected to the distal end surface of the panel and offset from the front surface of the panel in a same depthwise direction as the first return surface.

14. The method of claim 13 wherein the distal end surface of the panel forms a distal end surface of the elevator door, and wherein the first return surface and second return surface are coplanar, whereby the proximate J-channel and distal J-channel are configured to fixedly connect the panel to the elevator door.

15. The method of claim 9 wherein a unitary sheet of metal forms the panel.

16. The method of claim 9 including an elevator door and the panel fixedly connected to the elevator door.

* * * * *